US008887432B2

(12) United States Patent
Oz

(10) Patent No.: US 8,887,432 B2
(45) Date of Patent: Nov. 18, 2014

(54) HANDGUN CONVERTER

(75) Inventor: Moshe Oz, Ramat-Gan (IL)

(73) Assignee: CAA Industries Ltd., Kiryat Gat (IL)

( * ) Notice: Subject to any disclaimer, the term of this patent is extended or adjusted under 35 U.S.C. 154(b) by 447 days.

(21) Appl. No.: 12/906,218

(22) Filed: Oct. 18, 2010

(65) Prior Publication Data

US 2011/0088305 A1 Apr. 21, 2011

(30) Foreign Application Priority Data

Oct. 19, 2009 (IL) ..... 201628
Oct. 19, 2009 (IL) ..... 201629

(51) Int. Cl.
*F41C 23/00* (2006.01)
*F41C 23/12* (2006.01)

(52) U.S. Cl.
CPC ..... *F41C 23/12* (2013.01)
USPC ..... 42/71.02; 42/72; 42/71.01

(58) Field of Classification Search
USPC ..... 42/71.02, 90, 71.01, 72
See application file for complete search history.

(56) References Cited

U.S. PATENT DOCUMENTS

| | | | | |
|---|---|---|---|---|
| 1,367,996 | A * | 2/1921 | Sussman | 42/72 |
| 1,680,186 | A | 8/1928 | Von Frommer Rudolf | |
| 3,685,194 | A * | 8/1972 | Coon | 42/77 |
| 4,176,584 | A | 12/1979 | Thomas et al. | |
| 4,793,085 | A | 12/1988 | Surawski et al. | |
| 5,448,940 | A | 9/1995 | Schuetz et al. | |
| 6,318,014 | B1 * | 11/2001 | Porter | 42/72 |
| 6,493,978 | B1 | 12/2002 | Perkins | |
| 7,117,625 | B2 * | 10/2006 | Pikielny | 42/90 |
| 7,437,847 | B1 * | 10/2008 | Mabry | 42/71.02 |
| 7,552,557 | B1 * | 6/2009 | Mabry | 42/72 |
| 8,015,741 | B2 | 9/2011 | Hooks | |
| 2005/0268518 | A1 * | 12/2005 | Pikielny | 42/90 |
| 2006/0236583 | A1 * | 10/2006 | Pikielny | 42/85 |
| 2010/0024274 | A1 | 2/2010 | Lippard | |
| 2011/0010978 | A1 | 1/2011 | Hooks | |
| 2011/0030258 | A1 * | 2/2011 | Fistikchi et al. | 42/1.06 |
| 2011/0107644 | A1 * | 5/2011 | Faifer | 42/75.02 |
| 2011/0154710 | A1 | 6/2011 | Hatfield | |
| 2012/0131829 | A1 * | 5/2012 | Fistikchi et al. | 42/1.06 |

FOREIGN PATENT DOCUMENTS

| | | |
|---|---|---|
| CA | 2 631 979 | 11/2009 |
| FR | 1228795 | 6/1959 |
| WO | WO 2009095921 A2 * | 8/2009 |

OTHER PUBLICATIONS

Search Report of GB Application No: GB1017627.9 dated Nov. 2, 2011.

Israel's CAA Tactical launches Pistol-Rifle kit, Jane's International Defence Review, Jane's Information Group, Coulsdon, Surrey, GB, vol. 42, No. Nov, Nov. 1, 2009, p. 27, XP001558412, ISSN: 1476-2129.

Search Report of Application No: EP 10 18 8080 mailed on Mar. 24, 2014.

* cited by examiner

*Primary Examiner* — Jonathan C Weber
(74) *Attorney, Agent, or Firm* — Pearl Cohen Zedek Latzer Baratz LLP

(57) ABSTRACT

A handgun converter enclosing a handgun and allowing the user to operate the handgun with full and increased functionality and enhanced safety. The combined weapon endows the handgun with increased stability and accuracy due to additional supports, versatility by adding rails, and with an additional mechanical latch mechanism supporting safe use. The handgun converter is constructed to allow quick mounting and release of the handgun, to enhance weapon versatility.

16 Claims, 6 Drawing Sheets

HANDGUN CONVERTER

CROSS-REFERENCE TO RELATED APPLICATIONS

This application claims the priority of Israeli patent applications Nos. 201628 and 201629 filed on Oct. 19, 2009, both of which are incorporated by reference herein.

BACKGROUND

1. Technical Field

The present invention relates to the field of weaponry, and more particularly, to a handgun converter.

2. Discussion of Related Art

Handgun users are confronted with an occasional need to use a longer weapon. However, it is not practical to constantly carry both the handgun and the long barrel weapon.

U.S. Pat. Nos. 3,685,194 and 6,318,014, which are incorporated herein by reference in their entirety, disclose handgun converters and adapters.

BRIEF SUMMARY

Embodiments of the present invention provide a handgun converter comprising: a cocker attachable to a slide of a handgun and arranged to allow cocking the handgun by operating the cocker; a housing arranged, in an operational state, to enclose the handgun while allowing a user to operate the handgun, the housing comprising: a cocker opening arranged to accommodate the cocker in its full course needed to cock the handgun, wherein the cocker and the cocker opening are arranged to be operable from either a left side or a right side of the handgun converter; a grip opening arranged to accommodate a grip of the handgun; and a trigger cover movably connected to the housing and arranged to be movable to a safety position in which the trigger cover covers at least a part of a trigger guard of the handgun such as to prevent actuation of the trigger, wherein the handgun converter is arranged to enhance the operability and safety of the enclosed handgun.

These, additional, and/or other aspects and/or advantages of the present invention are: set forth in the detailed description which follows; possibly inferable from the detailed description; and/or learnable by practice of the present invention.

BRIEF DESCRIPTION OF THE DRAWINGS

The present invention will be more readily understood from the detailed description of embodiments thereof made in conjunction with the accompanying drawings of which.

DETAILED DESCRIPTION

Figure 1:
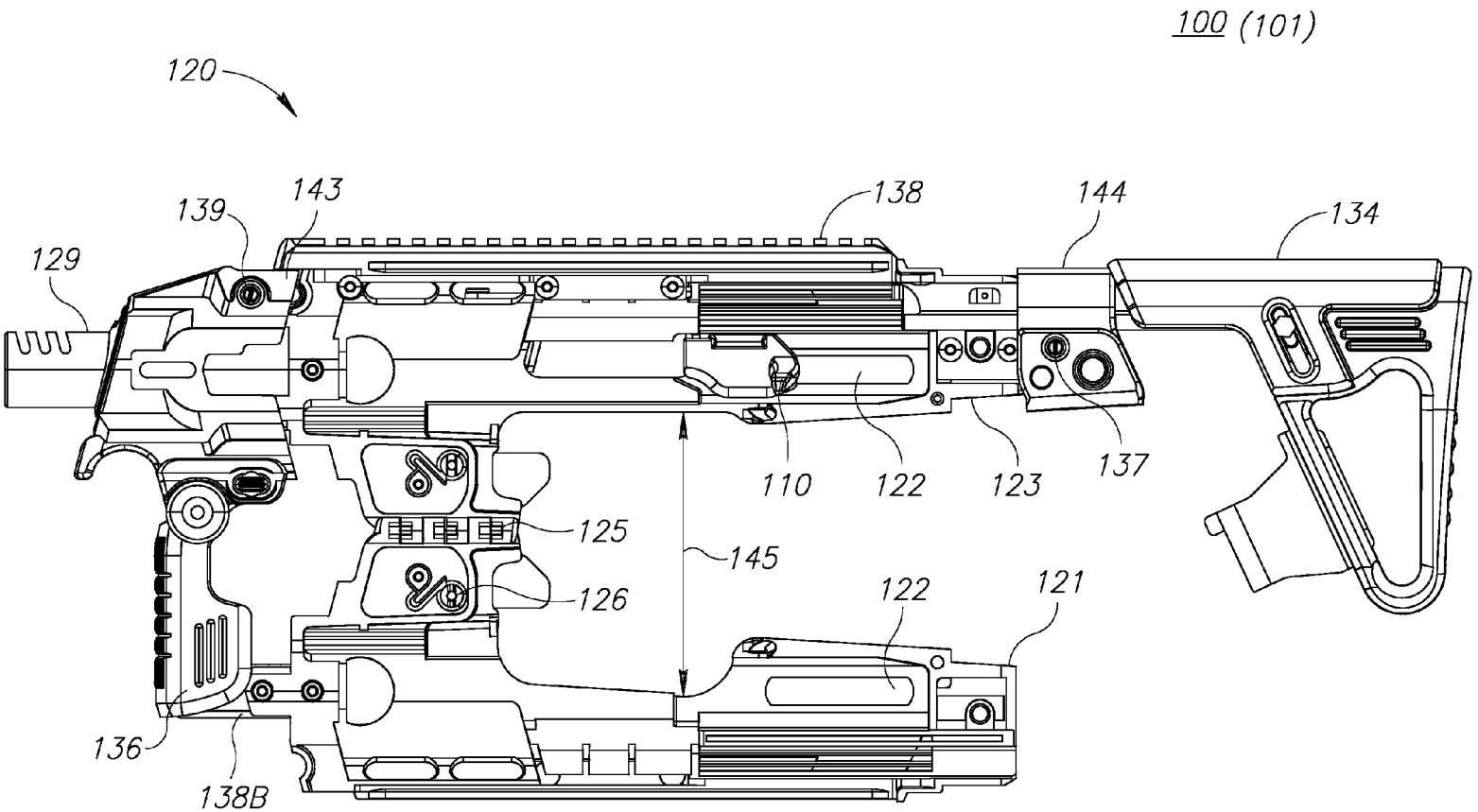
FIG. 1 is a high level schematic illustration of a handgun converter in an opened state, according to some embodiments of the invention.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

Figure 2:
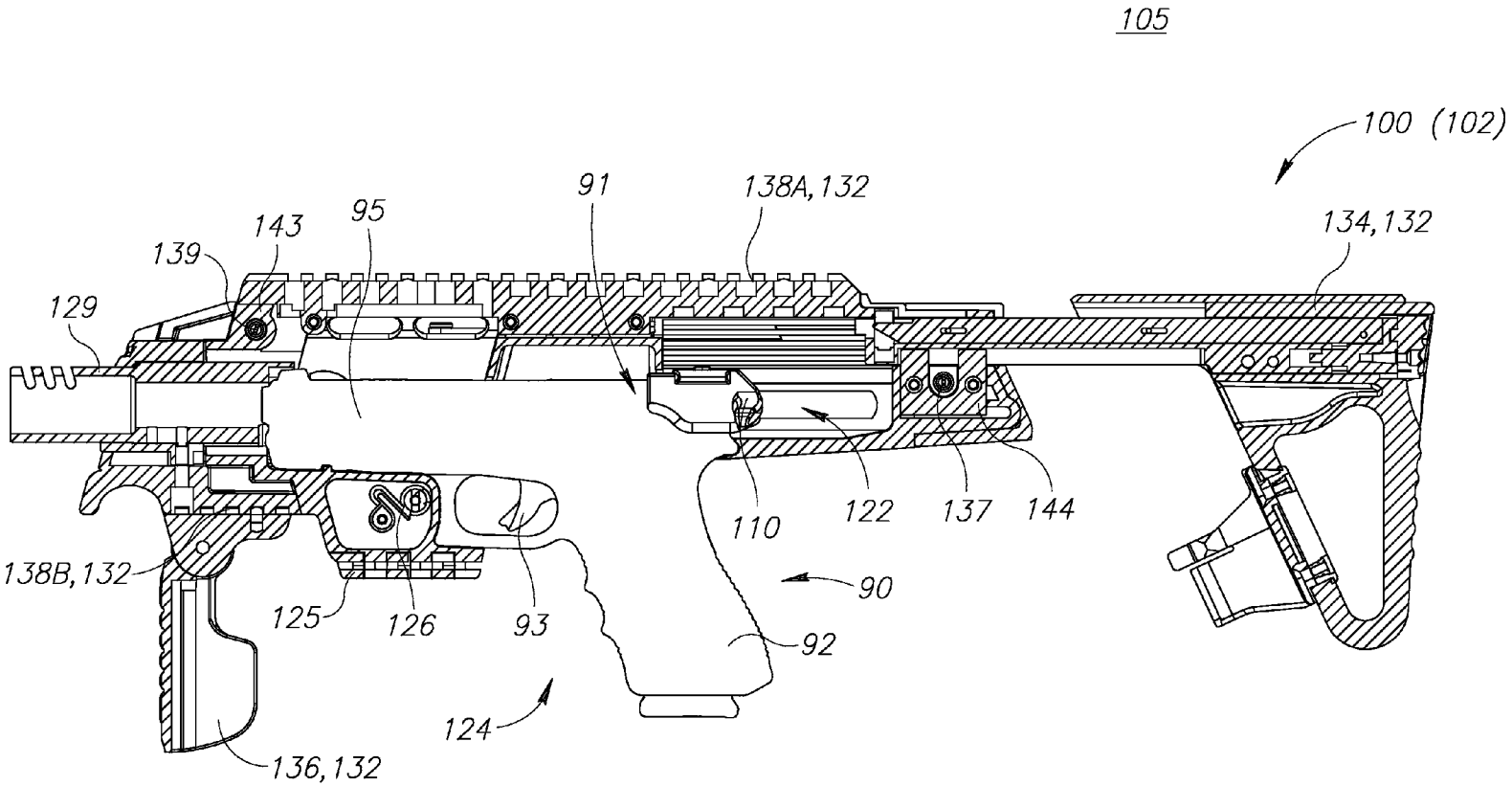
FIGS. 2 and 3 are high level schematic illustrations of a weapon comprising a handgun enclosed in the handgun converter in an operational state, according to some embodiments of the invention.
Figure 3:
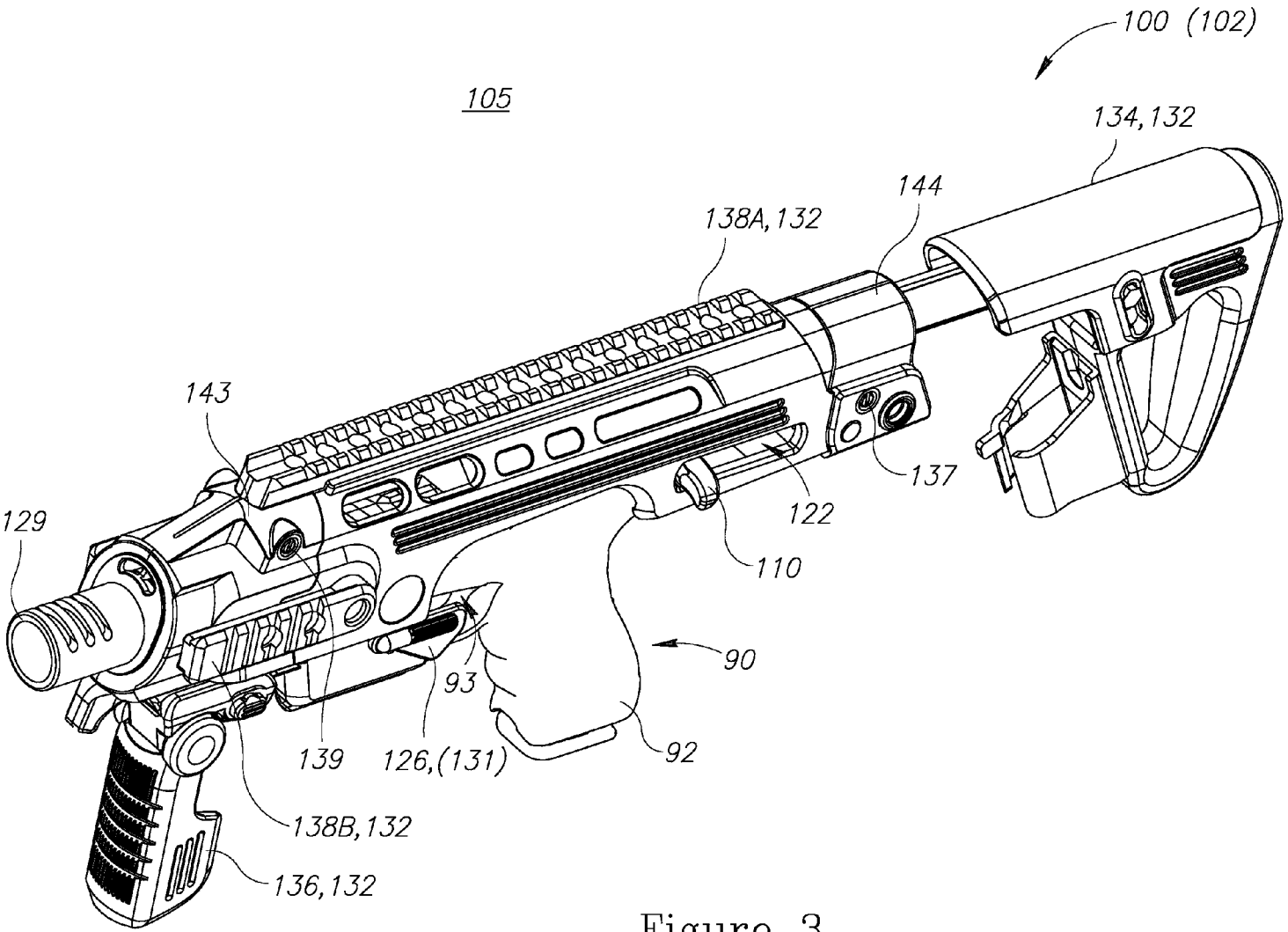
Figure 4B:
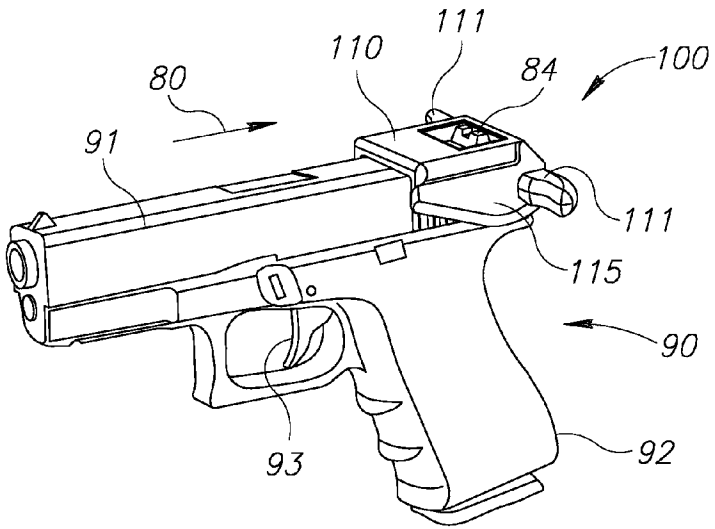
FIGS. 4A and 4B are high level schematic illustrations of a cocker mountable on the handgun as part of the handgun converter, according to some embodiments of the invention.
Figure 4A:
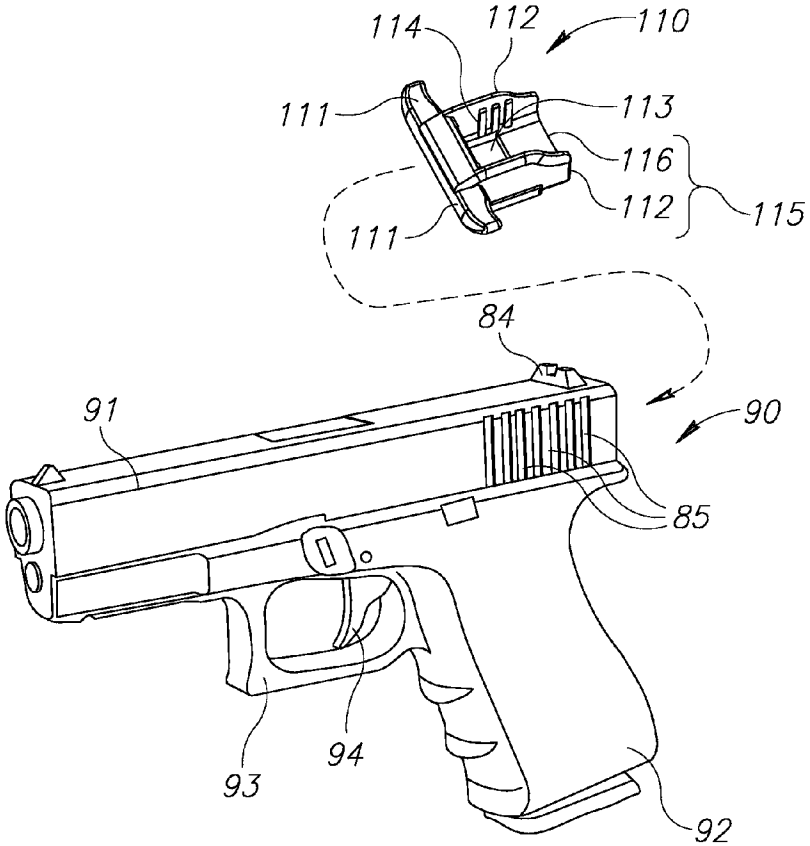

FIG. 1 is a high level schematic illustration of a handgun converter 100 in an opened state 101, according to some embodiments of the invention. FIGS. 2 and 3 are high level schematic illustrations (FIG. 2 is a cross section and FIG. 3 is a perspective view) of a weapon 105 comprising a handgun 90 enclosed in handgun converter 100 in an operational state 102, according to some embodiments of the invention. FIGS. 4A and 4B are high level schematic illustrations of a cocker 110 mountable on handgun 90 as part of handgun converter 100, according to some embodiments of the invention (in FIG. 4A grip 120 is not connected to handgun 90, in FIG. 4B grip 120 is connected to handgun 90 in an operational mode).

Handgun converter 100 comprises cocker 110 and a housing 120. Handgun converter 100 is arranged to enhance the operability and safety of enclosed handgun 90.

Cocker 110 is attachable to a slide 91 of handgun 90 and is arranged to allow cocking handgun 90 by operating cocker 110. Cocker 110 may be used to operate handgun 90 as an independent part. Cocker 110 may utilize surface features such as rills and protrusions in the back of slide 91 to affix slide 91 and ensure a smooth operation. Cocker 110 may be designed to allow operating handgun 90 by both right handed and left handed.

Cocker 110 may function as a slide pull apparatus for aiding in pulling slide 91 on handgun 90 (FIGS. 4A and 4B). Cocker 110 comprises a shell 115 configured to partially enclose a rear portion of slide 91. Shell 115 may comprise a plate 116 having an aperture 113 of a size configured to surround at least a portion of a rear aim sight 84 on handgun 90. Additionally shell 115 may include two sidewalls 112 extending downward from plate 116, each of two sidewalls 112 having an inner surface configured to each rest against a side portion of slide 91 of handgun 90. Pulling cocker 110 in a rearward direction (80) causes slide 91 to move in a rearward direction (80), thereby facilitating loading of handgun 90. Slide 91 may comprise at least one finger tab 111 projecting from shell 115, having a size configured to accommodate at least one finger of a human hand. Finger tab 111 may project laterally outward from one of cocker openings 122 in handgun converter 100. Cocker 110 may comprise two finger tabs 111, each projecting laterally outward from grip openings 122. The inner surface of two sidewalls 112 may comprise ribs 114 configured to affix cocker 110 onto slide 91, e.g. onto corresponding ribs 85 of slide 91.

Housing 120 is arranged, in an operational state, to enclose handgun 90 while allowing a user to operate handgun 90, such as to provide weapon 105 combining the advantages of handgun 90 and a longer weapon. The modularity of the combination of handgun 90 and handgun converter 100 allows for a flexible adaptation of weapon 105 according to the circumstances and dispenses of the need to carry both handgun 90 and a separate longer weapon.

Housing 120 comprises a grip opening 122 arranged to accommodate cocker 110 in its full course needed to cock handgun 90. Cocker 110 and cocker 110 opening are arranged to be operable from either a left side or a right side of handgun converter 100.

Housing 120 comprises a grip opening 124 arranged to accommodate a grip 92 of handgun 90 and allow convenient holding of weapon 105.

Housing 120 comprises a trigger cover 126 movably connected to housing 120 and arranged to be movable to a safety position 131 in which trigger cover 126 covers at least a part of a trigger guard 93 of handgun 90 such as to prevent actuation of trigger 94. By this feature, handgun converter 100 is arranged to enhance the safety of operating enclosed handgun 90.

Trigger cover 126 may be hingedly connected to housing 120 and arranged to be pivotly movable to safety position 131.

Handgun converter 100 may be arranged to have an open state 101 for inserting and removing handgun 90, and an operational state 102 in which handgun 90 is enclosed and operable within handgun converter 100. The transition from open state 101 to operational state 102 may be carried out by pivotly closing a hinged side 121 of housing 120 upon a body side 123 of housing 120 and securing hinged side 121 onto body side 123. Hinged side 121 and body side 123 may have ribs to secure them to each other and to handgun 90.

In open state 101, hinged side 121 of housing 120 may be positioned below body side 123, and hinged thereto at a pivot 125 positioned in front of in front of grip opening 124. Pivot 125 may be positioned at the upper part or at the lower part of body side 123. Pivot 125 may be positioned at the upper part or at the lower part of hinged side 121. Pivot 125 may be positioned in front of grip opening 124 or behind grip opening 124.

Handgun converter 100 may further comprise a flash suppressor 129 positioned continuingly to a barrel 95 of handgun 90 to shield flashes from barrel 95 of converted handgun 105. Flash suppressor 129 may be moveable between more than one position, such as to enable accommodation in housing 120 of handguns 90 with varying barrel lengths (e.g. Glock pistols 17 and 19). Flash suppressor 129 may be constructed to allow enclosing barrel extensions such as a silencer.

Handgun converter 100 may further comprise auxiliary elements 132 useable with weapon 105. For example, auxiliary elements 132 may comprise a butt 134, a handle 136 and rails 138A, 138B for attaching appliances to housing 120. Butt 134 may be extendable.

Handgun converter 100 may comprise a securing mechanism for securing hinged side 121 to body side 123 and thereby affixing handgun 90 within handgun converter 100. The securing mechanism may comprise moving parts arranged to tightly enclose hinged side 121 and body side 123.

For example, the moving parts may comprise flash suppressor 129 and butt 134, and The securing mechanism may comprise a front ring 143 and a rear ring 144 slidable along an axis of handgun converter 100 and arranged respectively to surround and secure the front ends and the rear ends of hinged side 121 and body side 123. Front ring 143 and rear ring 144 may be secured by pins 137, 139.

Butt 134 and flash suppressor 129 may be slidable along an axis of handgun converter 100 and may be associated or part of the securing mechanism (e.g. rear ring 144 may slide along the axis slidable butt 134, or front ring 143 may be connected to flash suppressor 129).

Handgun converter 100 with enclosed handgun 90 may function as weapon 105 comprising handgun 90 enclosed in handgun converter 100, wherein trigger cover 126 is hingedly connected to housing 120 and arranged to be pivotly movable to safety position 131, wherein handgun converter 100 is further arranged to have open state 101 for inserting and removing handgun 90, wherein a transition from open state 101 to operational state 102 is carried out by pivotly closing hinged side 121 of housing 120 upon body side 123 of housing 120 and securing hinged side 121 onto body side 123, wherein handgun converter 100 further comprises: flash suppressor 129 positioned continuingly to barrel 95 of handgun 90; auxiliary elements 132 to weapon 105, comprising at least one of: butt 134; handle 136; and at least one rail 138A or 138B for attaching appliances to housing 120, such as sights or a laser target designator. Weapon 105 is arranged to be cocked using cocker 110, and has an enhanced operability and safety in respect to handgun 90 alone, due to handgun 90's enclosure in handgun converter 100.

Figure 5:
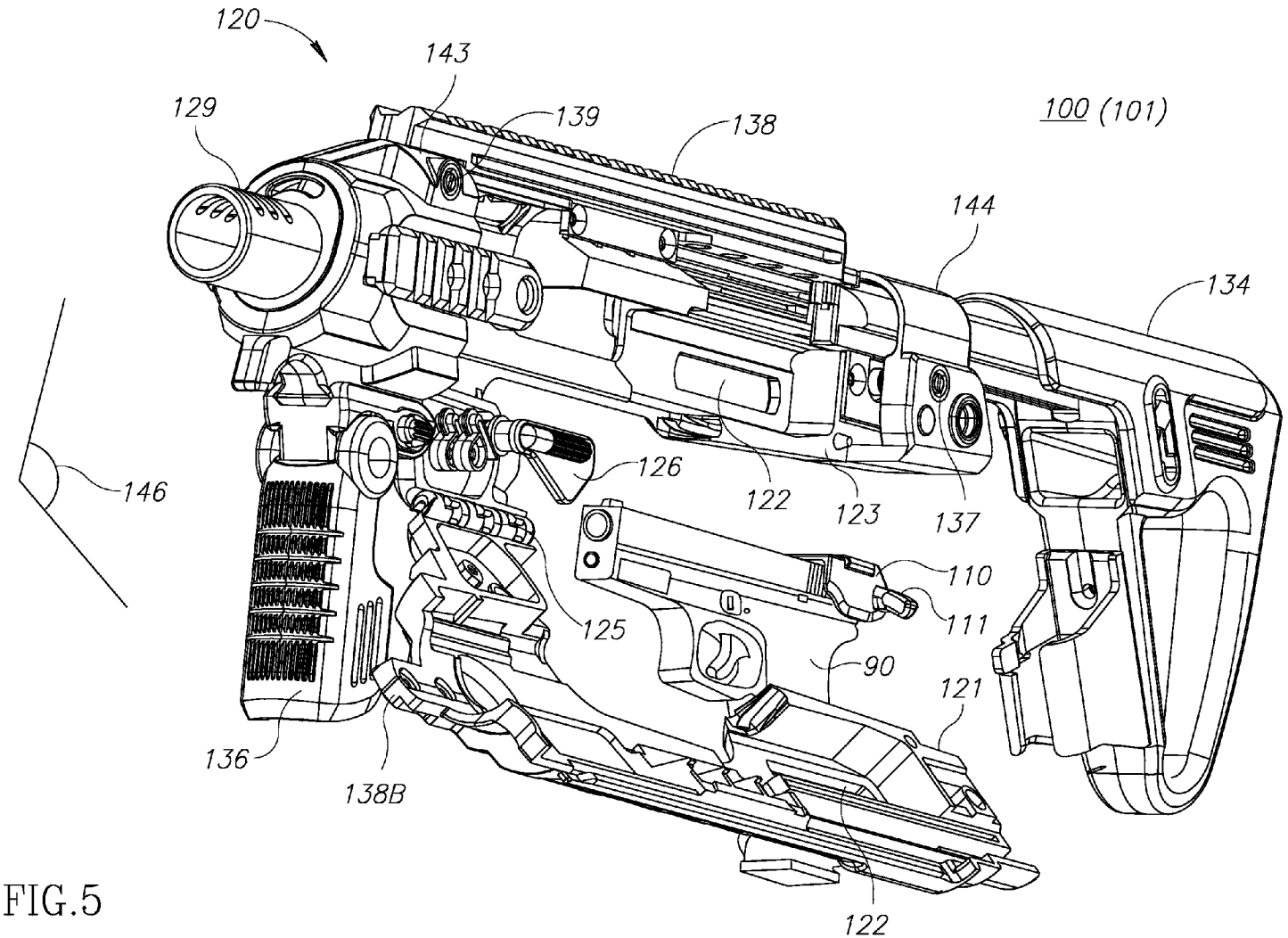
FIG. 5 is a high level schematic illustration of a configuration of the handgun converter in the opened state, which allows loading the handgun into the handgun converter, according to some embodiments of the invention.

FIG. 5 is a high level schematic illustration of a configuration of handgun converter 100 in opened state 101, which allows loading handgun 90 into handgun converter 100, according to some embodiments of the invention.

The opening angle of hinged side 121 in respect to body side 123 may be limited to a specified angle 146 substantially smaller than 180°, to allow the enclosure of long grip handguns 90.

For example, rail 138B may positioned such as to define specified opening angle 146 of handgun converter 100 by acting as a stopper against handle 136 and mechanically disabling further movement of hinged side 121. Keeping opening angle 146 smaller than 180° allows inserting to handgun converter 100 handguns 90 with a long grip in respect to gap 145 between hinged side 121 and body side 123.

Figure 6:
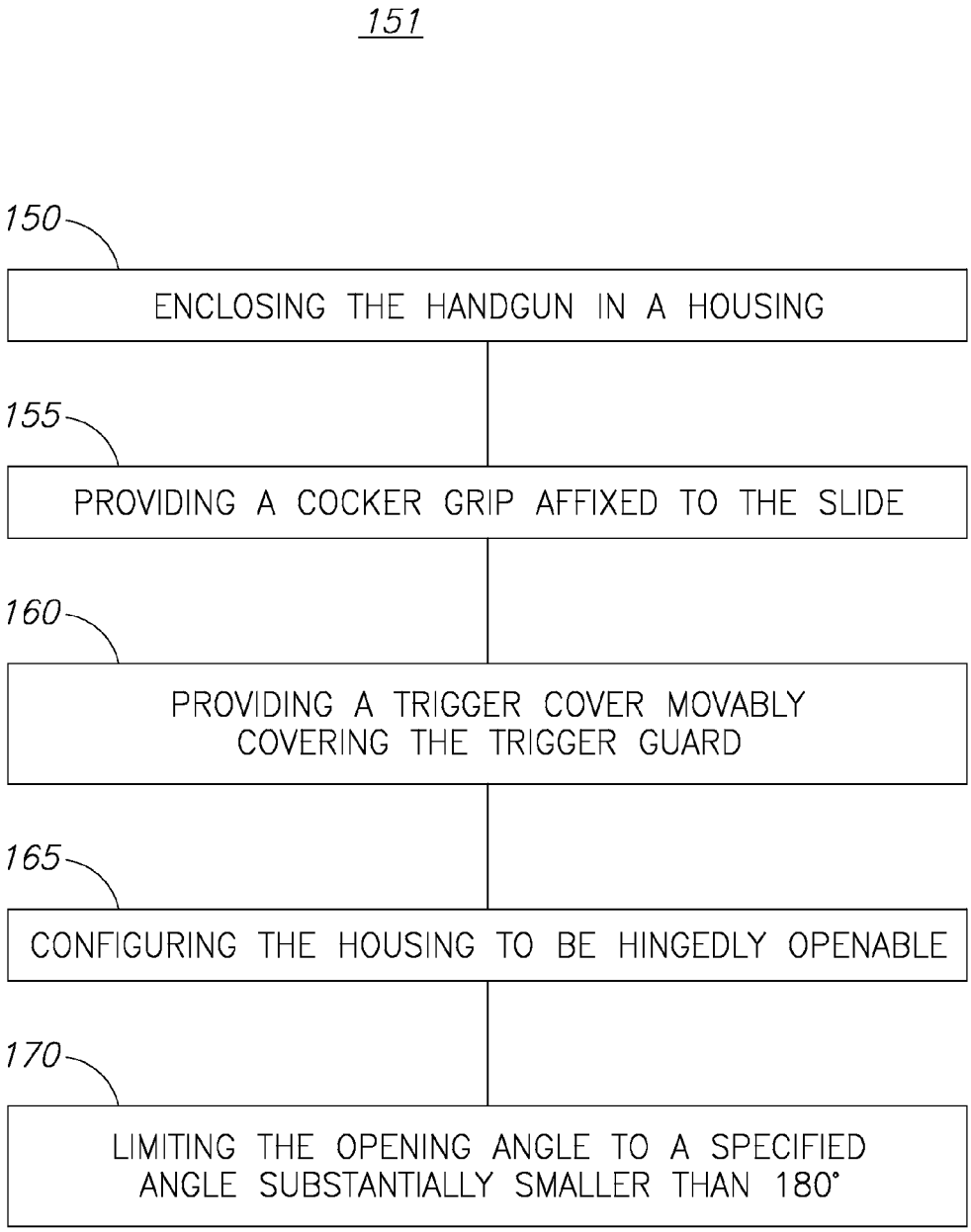
FIG. 6 is a high level schematic flowchart of a method of enhancing the operability and safety of a handgun, according to some embodiments of the invention.

FIG. 6 is a high level schematic flowchart of a method 151 of enhancing the operability and safety of a handgun, according to some embodiments of the invention.

Method 151 comprises the following stages: enclosing the handgun in a housing (stage 150), to allow a user operate the handgun unhindered and with enhanced operability provided by parts of the housing; and providing a trigger cover movably connected to the housing (stage 160) and arranged to be movable to a safety position in which the trigger cover covers at least a part of a trigger guard of the handgun such as to prevent actuation of the trigger, to yield an enhanced safety of operation of the handgun.

Method 151 may further comprise providing a cocker (stage 155) gripping a slide of the handgun, to allow cocking the handgun while enclosed in the housing by using the cocker.

Method 151 may further comprise configuring the housing to be hingedly openable to allow the enclosing of the handgun therewithin (stage 165), optionally wherein the configuring comprises limiting the opening angle to a specified angle substantially smaller than 180° to allow the enclosure of long grip handguns (stage 170).

In embodiments, handgun converter 100 encloses handgun 90 and allows the user to operate handgun 90 with full and increased functionality and enhanced safety. Combined weapon 105 endows handgun 90 with increased stability and accuracy due to the length of combined weapon 105 and the integration of additional supports 132, versatility by adding rails (138A, 138B), and with an additional mechanical latch mechanism as trigger cover 126 to support safe use. Handgun converter 100 is constructed to allow quick mounting and release of handgun 90, to enhance weapon 105 versatility.

In the above description, an embodiment is an example or implementation of the invention. The various appearances of "one embodiment", "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Furthermore, it is to be understood that the invention can be carried out or practiced in various ways and that the invention can be implemented in embodiments other than the ones outlined in the description above.

The invention is not limited to those diagrams or to the corresponding descriptions. For example, flow need not move through each illustrated box or state, or in exactly the same order as illustrated and described.

Meanings of technical and scientific terms used herein are to be commonly understood as by one of ordinary skill in the art to which the invention belongs, unless otherwise defined.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

What is claimed is:

1. A handgun converter comprising:

a cocker attachable to a slide of a handgun and arranged to allow cocking the handgun by operating the cocker;

a housing arranged, in an operational state, to enclose the handgun while allowing a user to operate the handgun, the housing comprising:

a cocker opening arranged to accommodate the cocker in its full course needed to cock the handgun, wherein the cocker and the cocker opening are arranged to be operable from either a left side or a right side of the handgun converter; and a grip opening arranged to accommodate a grip of the handgun, wherein the housing further comprises a trigger cover movably connected to the housing and arranged to be movable to a safety position in which the trigger cover covers at least a part of a trigger guard of the handgun such as to prevent actuation of the trigger.

2. The handgun converter of claim 1, wherein the trigger cover is hingedly connected to the housing and arranged to be pivotally movable to the safety position.

3. The handgun converter of claim 1, further arranged to have an open state for inserting and removing the handgun, wherein a transition from the open state to the operational state is carried out by pivotally closing a hinged side of the housing upon a body side of the housing and securing the hinged side onto the body side.

4. The handgun converter of claim 3, wherein in the open state, the hinged side of the housing is positioned below the body side, and hinged thereto at a pivot positioned in front of the grip opening.

5. The handgun converter of claim 4, wherein an opening angle of the hinged side in respect to the body side is limited to a specified angle substantially smaller than 180° to allow the enclosure of long grip handguns.

6. The handgun converter of claim 4, wherein the limiting is carried out by a rail affixed to hinged side, stopping a pivotal movement of the hinged side against a grip affixed to the body side.

7. The handgun converter of claim 4, further comprising a securing mechanism arranged to secure the hinged side to the body side.

8. The handgun converter of claim 7, wherein the securing mechanism comprises a slidable front ring and a slidable rear ring.

9. The handgun converter of claim 1, further comprising a flash suppressor positioned continuingly to a barrel of the handgun.

10. The handgun converter of claim 9, wherein the flash suppressor is moveable to accommodate handgun barrels of different lengths.

11. The handgun converter of claim 1, further comprising auxiliary elements to the converted handgun, comprising at least one of: a butt, and a handle.

12. The handgun converter of claim 1, further comprising at least one rail for attaching appliances to the housing.

13. A weapon comprising:

a handgun enclosed in the handgun converter of claim 1, wherein the trigger cover is hingedly connected to the housing and arranged to be pivotally movable to the safety position, wherein the handgun converter further comprises:

a flash suppressor positioned continuingly to a barrel of the handgun;

auxiliary elements to the weapon, comprising at least one of: a butt; a grip; and at least one rail for attaching appliances to the housing, and wherein the weapon is arranged to be cocked using the cocker, and has an enhanced operability and safety in respect to the handgun alone, due to the handgun's enclosure in the handgun converter.

14. A method for converting a handgun to a longer weapon, the method comprising:

enclosing the handgun in a housing;

providing a cocker gripping a slide of the handgun, to allow cocking the handgun while enclosed in the housing by using the cocker; and providing a trigger cover movably connected to the housing and arranged to be movable to a safety position in which the trigger cover covers at least a part of a trigger guard of the handgun such as to prevent actuation of the trigger.

15. The method of claim 14, further comprising configuring the housing to be hingedly openable to allow the enclosing of the handgun therewithin.

16. The method of claim 15, wherein the configuring comprises limiting the opening angle to a specified angle substantially smaller than 180° to allow the enclosure of long grip handguns.

* * * * *